US009816770B2

(12) United States Patent
Sumoba et al.

(10) Patent No.: US 9,816,770 B2
(45) Date of Patent: Nov. 14, 2017

(54) BARREL COOLER AND EMPTY CHAMBER INDICATOR

(71) Applicants: Bryan Sumoba, Morgan Hill, CA (US); Kamran Honardoost, Fremont, CA (US)

(72) Inventors: Bryan Sumoba, Morgan Hill, CA (US); Kamran Honardoost, Fremont, CA (US)

(73) Assignee: Reliant Engineering and Manufacturing Services, Inc., Fremont, CA (US)

( * ) Notice: Subject to any disclaimer, the term of this patent is extended or adjusted under 35 U.S.C. 154(b) by 0 days.

(21) Appl. No.: 15/225,793

(22) Filed: Aug. 1, 2016

(65) Prior Publication Data

US 2017/0082387 A1 Mar. 23, 2017

Related U.S. Application Data

(60) Provisional application No. 62/220,097, filed on Sep. 17, 2015.

(51) Int. Cl.
*F41A 13/10* (2006.01)
*F41A 9/53* (2006.01)

(52) U.S. Cl.
CPC ..... *F41A 13/10* (2013.01); *F41A 9/53* (2013.01)

(58) Field of Classification Search
CPC ..... F41A 9/53
See application file for complete search history.

(56) References Cited

U.S. PATENT DOCUMENTS 1,160,778 A * 11/1915 Smart ..... F41A 13/04 89/1.2
4,852,454 A * 8/1989 Batchelder ..... F41B 9/0037 361/232
5,117,734 A * 6/1992 Rhoads ..... F41A 13/10 89/1.2
7,866,082 B2 * 1/2011 Eisenberg ..... F41H 13/0087 362/109
8,677,879 B1 * 3/2014 Gresham ..... F41A 13/04 42/106
8,763,509 B1 * 7/2014 Nagel ..... F41A 13/10 261/152
2007/0039224 A1 * 2/2007 Skinner ..... F41A 29/00 42/106

* cited by examiner

*Primary Examiner* — Stephan M Johnson
(74) *Attorney, Agent, or Firm* — GSS Law Group

(57) ABSTRACT

An enclosure holds an air mover, a switch, and a power source such as one or more electric storage batteries. A hollow outflow tube receives air drawn into the enclosure by the air mover. An end of the outflow tube has an outer diameter selected to pass through the action of a firearm and into the firing chamber. When the end of the outflow tube is inserted into the chamber and the air mover is turned on, ambient air is drawn into the enclosure, through the air mover, through the outflow tube, into the chamber, through the bore of the barrel, and out the muzzle, thereby cooling the firearm's barrel. When the end of the outflow tube is inserted into a chamber, an embodiment provides a visual indication that the chamber does not contain a cartridge.

17 Claims, 8 Drawing Sheets

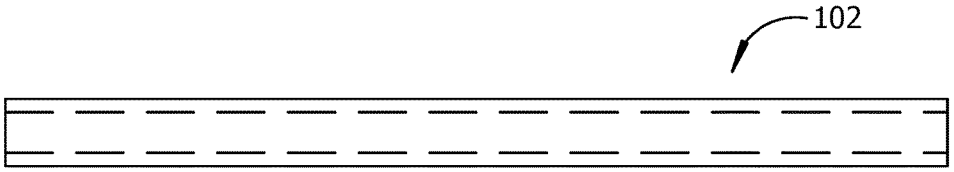
Fig. 7
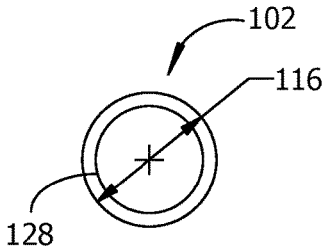
Fig. 8
Fig. 9
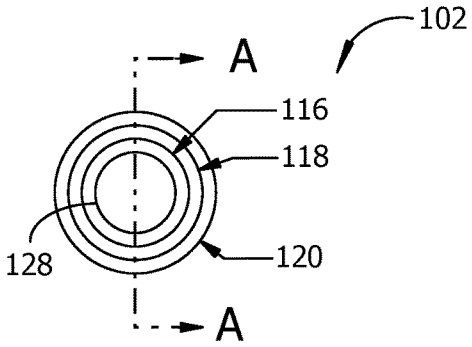
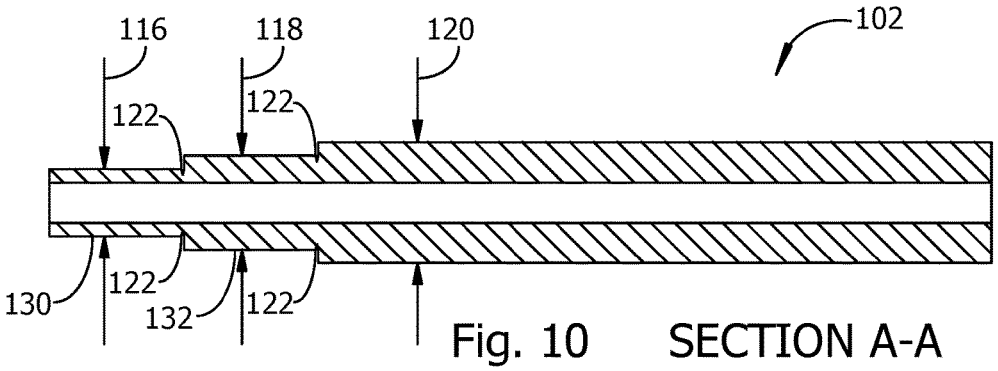
Fig. 10 SECTION A-A

BARREL COOLER AND EMPTY CHAMBER INDICATOR

This application claims priority from U.S. provisional application 62/220,097, as filed on Sep. 9, 2017. Embodiments are related to apparatus for cooling the barrel of a firearm, and are further related to apparatus for providing a visual indication that a chamber in a firearm does not contain a cartridge.

FIELD OF THE INVENTION

Background

A firearm with a hot barrel may make aiming less precise and may increase wear of the surface of the bore in the barrel. Cooling a hot barrel may improve the accuracy and service life of a firearm. A hot barrel may be cooled by standing a firearm upright with the action open to draw cool air in through the action and exhaust warm air out the muzzle by convective airflow. Cooling liquid such as water may be directed at the outside of the barrel or through the bore to increase the rate of cooling of the barrel. More than one firearm may be carried so that one may cool while another is being fired, or a hot barrel may be exchanged with a cool barrel.

Examples of apparatus for cooling hot barrels include devices with a fan in an enclosure adapted to fit into a receiver in a firearm for a magazine. Cooling air may flow through the receiver, into the firing chamber, and out the muzzle. However, a fan with an enclosure that fits into a receiver on a particular firearm may not be usable with other firearms.

Other devices direct air from a fan or compressed air source to a cooling case adapted for a close fit in the firing chamber. Cooling devices using compressed air may need air canisters that are difficult to carry, replace, or refill, and the devices may be useless if filled canisters are not available when needed. The size and shape of the cooling case may resemble the case of a cartridge for the firearm to achieve a close fit in the chamber and reduce cooling air leaking out of the breech end of the barrel. It may be difficult to distinguish the case used for cooling from a case for a cartridge of a functional round of ammunition. Mistaking a cartridge with a bullet for a cooling case may cause an unsafe condition when a firearm believed to be set up for barrel cooling actually contains a live round. Or the cooling case may inadvertently be left in the chamber, possibly causing damage to the cooling case or the action should the action be operated. A case sized for the chamber of one firearm may not fit into the chamber of another firearm.

Yet other devices inject liquid water or a fine mist into the barrel to cool the barrel by evaporative cooling. Water remaining in the bore after cooling is complete may need to be removed by swabbing and oiling to prevent corrosion. Water may loosen deposits in the bore which should be removed before firing. Water applied to the exterior of a barrel may become trapped between the barrel and stock, possibly causing corrosion of the barrel or damage to the stock.

Safety rules at a firing range may require that firearms are to be unloaded and show a clear visual indication of an empty chamber after a cease-fire command is given. An empty chamber indicator (ECI) may use a flag or plug inserted into a chamber as a clearly visible signal that the chamber does not contain a cartridge. An ECI preferably has a high-visibility color and is large enough that its presence or absence can easily be determined by a range safety officer and by everyone on the firing line. Range safety rules may prohibit any contact with a firearm after the ECI is put in place until authorization to resume firing is issued. Removing an ECI after a cease-fire command to insert a barrel cooling device may not be permitted by range safety rules. An ECI inserted in a chamber may interfere with cooling the barrel.

SUMMARY

An example apparatus embodiment includes an enclosure formed with an internal plenum; an air mover positioned inside the enclosure, the air mover positioned to draw air from outside the enclosure into the plenum; a hollow outflow tube attached to the enclosure, the outflow tube in fluid communication with the plenum, and the outflow tube having an end sized for a close fit into a firing chamber in a firearm.

The example apparatus may optionally include a switch attached to the enclosure; and at least two electrical contacts for at least one electric storage battery. The switch and the at least two electrical contacts are electrically connected with the air mover.

The outflow tube may be removably attached to the enclosure. The outflow tube may include a first segment formed with a first outer diameter and a second segment formed with a second outer diameter. The outflow tube may be formed with a groove to enable the first segment to be removed from the second segment. An end of the outflow tube may be formed with a conical surface. The end of the outflow tube may alternatively be formed with a spherical surface.

The example apparatus may include a collar slidably engaged with an outflow tube. The collar may optionally be formed with a conical surface or may alternatively be formed with a spherical surface.

The enclosure portion of an embodiment preferably remains outside an action of a firearm when the outflow tube is coupled to the firing chamber of the firearm.

BRIEF DESCRIPTION OF THE DRAWINGS

FIG. 7 is a side view of an example outflow tube.

FIG. 8 is an end view of the example outflow tube of FIG. 7.

FIG. 9 is an end view of an alternative example of an outflow tube.

FIG. 10 is a cross-sectional view of the example outflow tube from FIG. 9.

DESCRIPTION

An example apparatus embodiment includes a small enclosure holding an air mover, a switch, and a power source such as an electric storage battery. Air drawn into the enclosure by the air mover passes into a plenum and through a hollow outflow tube. An end of the outflow tube opposite the plenum has an outer diameter selected to pass through the action of a firearm and into the firing chamber. The firing chamber, also referred to herein as the chamber, is an aperture at the breech end of the barrel where a cartridge may be inserted for firing. When the air mover is turned on, ambient air is drawn into the enclosure, through the air mover, through the plenum and outflow tube, into the chamber at the breech end of the bore, and out the muzzle of the firearm's barrel.

The end of the outflow tube preferably enters the chamber as a visual indication that the chamber does not contain a cartridge. The enclosure containing the air mover preferably remains outside the action. The enclosure and outflow tube are preferably colored with a bright color easily distinguished from the colors of external parts of a firearm to enhance the visibility of the device to persons in the vicinity of the firearm. An embodiment may therefore simultaneously cool a barrel and serve as an empty chamber indicator (ECI). Some embodiments are provided with modifications to the outflow tube to permit a single device to function as an ECI and cool barrels of differing bore sizes.

An embodiment may be an ECI. An embodiment that is an ECI may comply with safety rules for firing ranges. For example, while in use on a firearm, the outflow tube preferably extends far enough into the firing chamber to confirm that the chamber does not contain a cartridge for the firearm. A portion of the outflow tube and the enclosure are preferably large enough and extend outward from the action far enough to be readily visible to persons in the vicinity of the firearm, for example line staff, referees, and other persons near firing positions at a firing range. Furthermore, the outflow tube and enclosure are preferably colored with a high-visibility color such as yellow or orange. An example of requirements for an ECI may be found in "NRA High Power Rifle Rules", copyright 2016 by the National Rifle Association of America.

Figure 1:
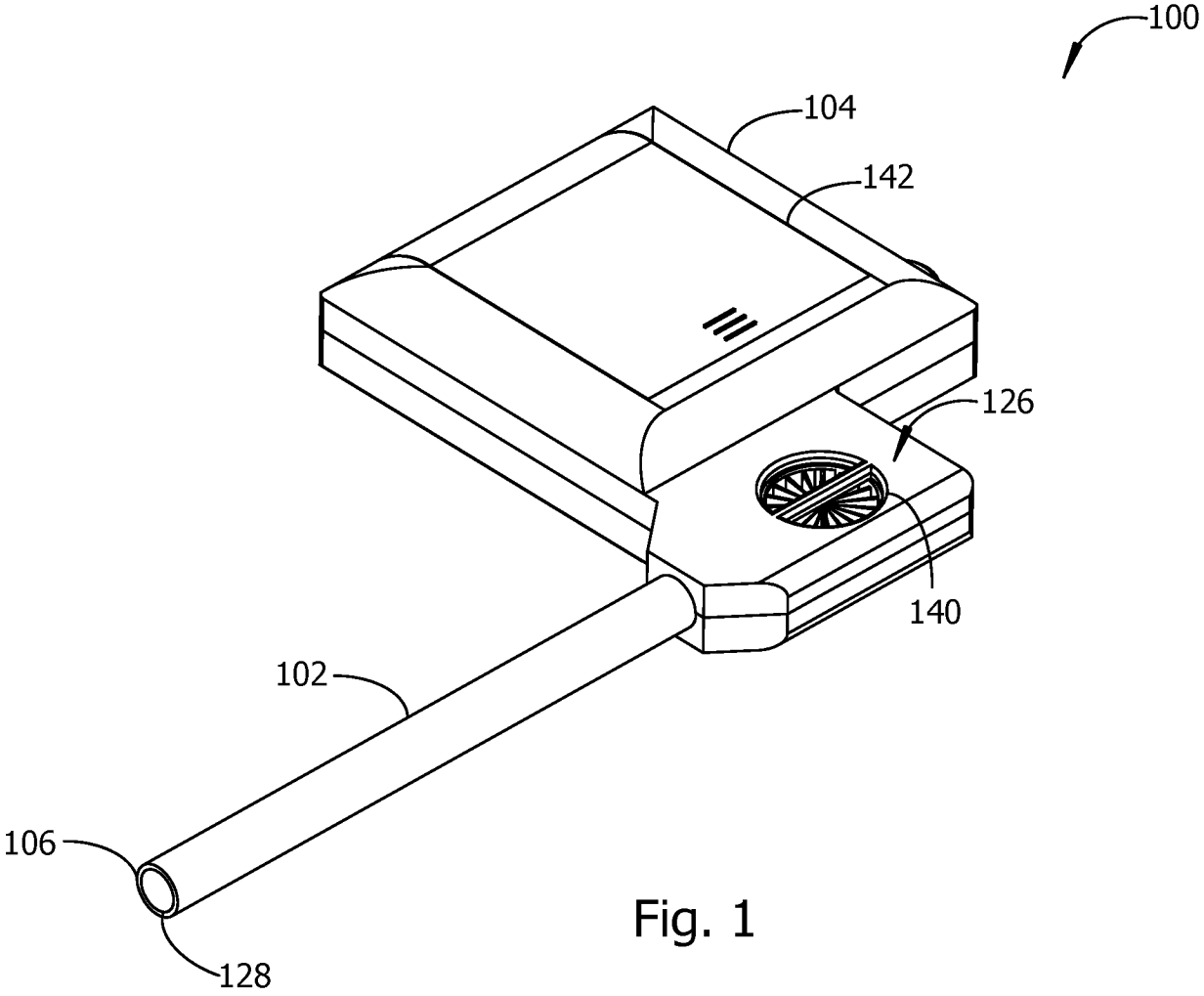
FIG. 1 shows a pictorial view of an example embodiment having an enclosure, air mover, and outflow tube.
Figure 2:
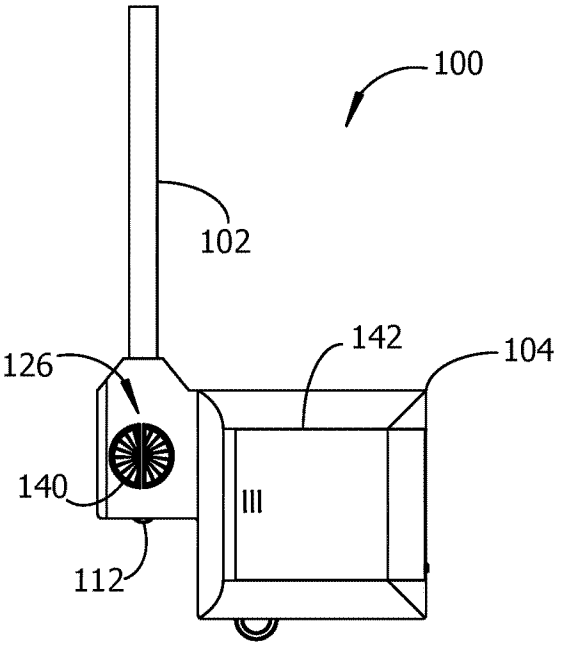
FIG. 2 shows a view toward top side of the example embodiment of FIG. 1.
Figure 3:
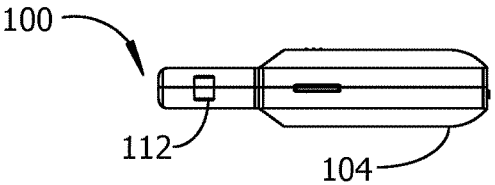
FIG. 3 shows an end view of the example embodiments of FIGS. 1-2.
Figure 4:
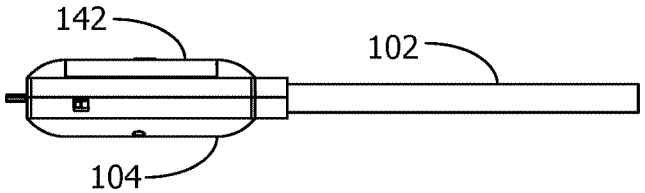
FIG. 4 shows a side view of the example embodiments of FIGS. 1-3.

Turning now to the figures, FIG. 1 shows a pictorial view of an example embodiment 100 of a combined barrel cooler and ECI. FIGS. 2, 3, and 4 show front, end, and side views of the example embodiment of FIG. 1. As shown in the figures, a hollow outflow tube 102 is attached to an enclosure 104. The enclosure provides interior space for an air mover 126. In some embodiments, the enclosure also provides interior space for batteries under a battery cover 142. When the air mover 126 is operating, ambient air drawn into the enclosure 104 through an air inlet aperture 140 exits through an air outlet aperture 128 at an end 106 of the outflow tube 102. The air mover 126 may be activated for cooling a barrel by turning on a switch 112 visible in FIGS. 2 and 3. The switch 112 may optionally be illuminated to indicate when the air mover is operating.

Figure 6:
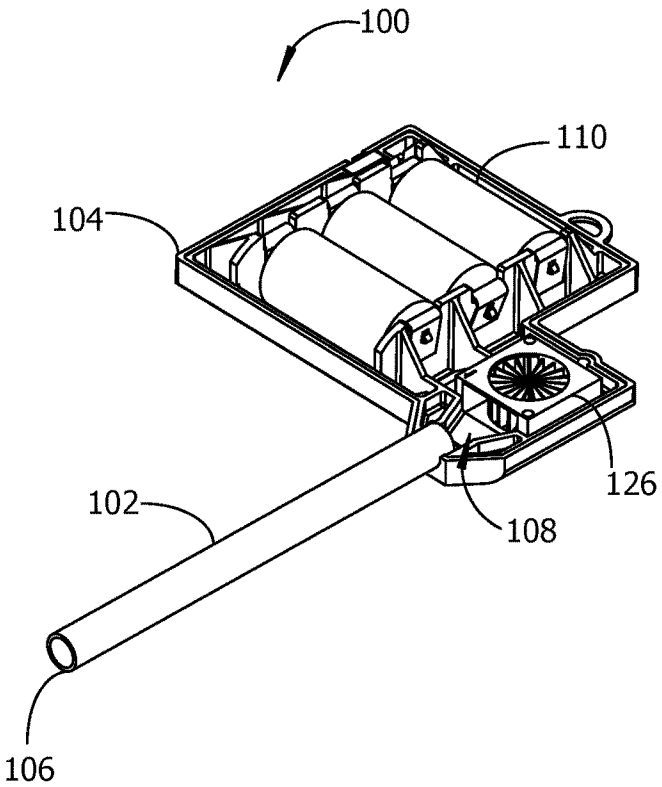
FIG. 6 is a partial pictorial view of the example embodiment of FIG. 5.
Figure 5:
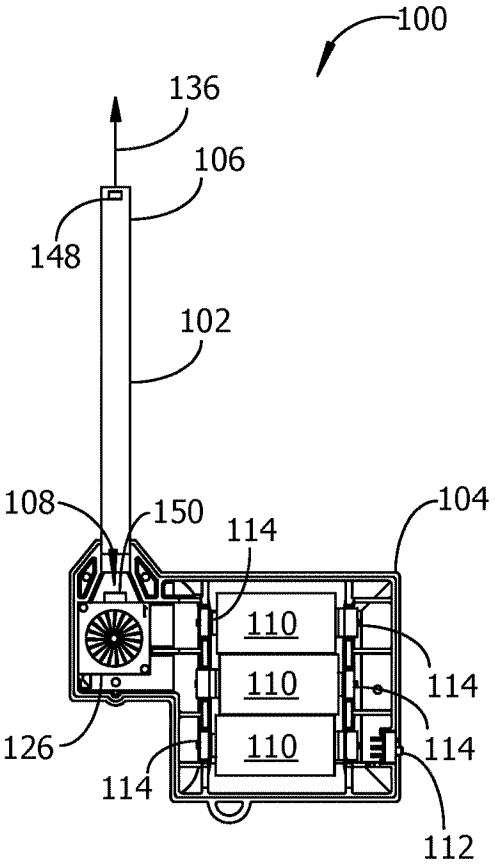
FIG. 5 shows a partial top view of the example embodiment of FIG. 2, with part of the enclosure removed to show examples of internal details.
Figure 11:
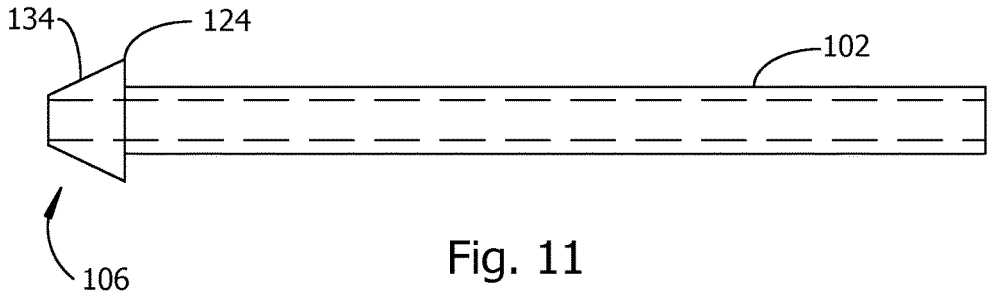
FIG. 11 is a side view of an alternative example of an outflow tube with a conical end surface.
Figure 12:
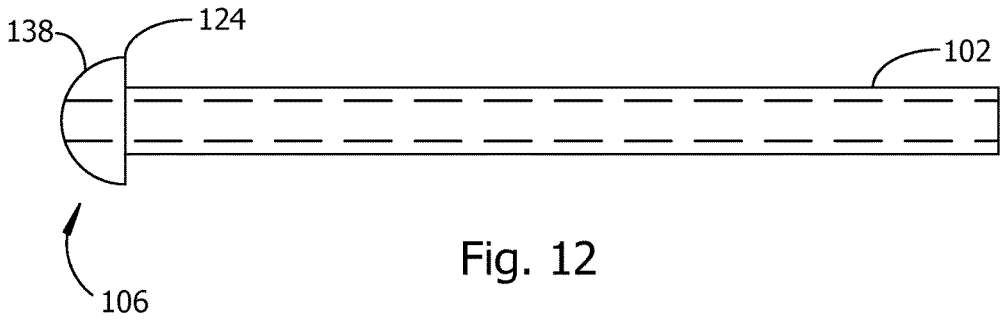
FIG. 12 is a side view of another alternative example of an outflow tube with a spherical end surface.

FIG. 5 shows a view toward the front side of the example embodiment 100. Part of the enclosure 104 has been removed to show some internal details. FIG. 6 shows the example of FIG. 5 in a pictorial view. The switch 112, electrical contacts 114 for batteries 110, and air mover 126 are coupled to one another in an electrical circuit contained within the enclosure 104. The enclosure protects circuit components from dirt and damage and prevents a person from touching moving parts. An arrow 136 indicates the direction of airflow at the end of the outflow tube 102 while the air mover 126 is operating. Ambient air drawn into the enclosure 104 by the air mover 126 passes into a plenum 108 formed in the enclosure. The hollow interior of the outflow tube 102 is in fluid communication with the plenum 108. Examples of the air mover 126 include, but are not limited to, an axial-flow fan, a blower, and a piezoelectric air mover having vibrating blades or a vibrating diaphragm.

Electric power for operating the air mover 126 may be supplied from batteries 110 or may alternatively be supplied from a power supply module having a connector suitable for plugging into an alternating current (AC) electrical outlet. The enclosure 104 may optionally include an electrical connector capable of coupling with a corresponding electrical connector on the power supply module. The batteries 110 may be rechargeable and the power supply module may include a charging circuit for recharging the batteries. Alternatively, a charging circuit may be included in the enclosure 104.

In some embodiments, the outflow tube 102 is removably coupled to the enclosure 104. In alternative embodiments, the outflow tube may be integrally formed with the enclosure or formed separately and joined to the enclosure with a fastener, by threading of the outflow tube and enclosure, by bonding with adhesive, or by fusing. The outflow tube may be formed as a hollow cylinder with a longitudinal interior void and an outflow aperture 128, as suggested in the examples of FIGS. 7-8. The outer diameter 116 of the outflow tube 102 may be sized for a close fit in a chamber of a firearm. An embodiment may optionally include more than one replaceable outflow tube, each outflow tube optionally having a different outer diameter 116.

FIGS. 9-13 show examples of alternative outflow tube embodiments. The end view of an example outflow tube 102 in FIG. 9 is formed with more than one outer diameter, including a first outer diameter 116, a second outer diameter 118, and a third outer diameter 120. Each outer diameter may be selected for a sliding fit in a different size chamber in a firearm. FIG. 10 shows a cross-sectional view A-A of the example outflow tube from FIG. 9. The first outer diameter 116 may apply to a first segment 130, the second outer diameter 118 may apply to a second segment 132, and the third outer diameter 120 may apply to the remainder of the outflow tube 102. The airflow outlet aperture 128 is in fluid communication with the plenum in the enclosure 104 when the outflow tube is coupled to the enclosure.

In some embodiments the outflow tube is rigid. An outflow tube may alternatively be made from a flexible material. The example outflow tube of FIGS. 9-10 may optionally be made from a material that can be readily cut with a pair of scissors or knife to remove an unwanted segment of the tube. Alternatively, the outflow tube 102 may be made from a frangible material so that the separable segments (130, 132) can be snapped off the outflow tube to leave a segment with an outer diameter that best fits in the chamber in a selected firearm. A segment may optionally be formed with a circumferential groove 122 to establish a preferred breaking location between separable segments.

An outflow tube may include an end 106 shaped to establish a seal against firing chambers of different sizes. For the example outflow tube 102 of FIG. 11, the end 106 of the outflow tube is formed with a collar 124 having a conical surface 134. The conical surface may contact an edge of a chamber to establish a seal, with part of the conical surface entering the chamber as a confirmation that the chamber does not contain a cartridge. For the example outflow tube 102 of FIG. 12, the end 106 of the outflow tube 102 is formed with a collar 124 having a spherical surface 138.

Figure 13:
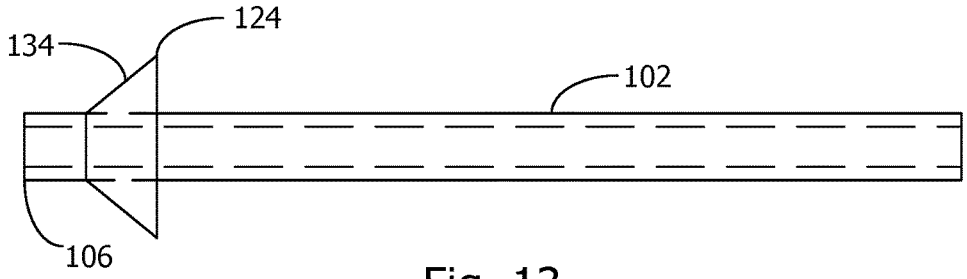
FIG. 13 is a side view of another alternative example an outflow tube with a collar.
Figure 14:
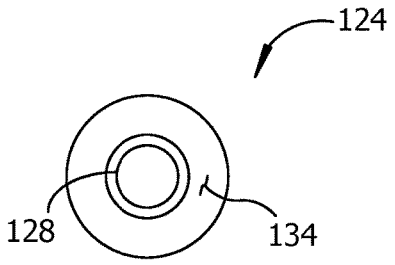
FIG. 14 is a front view of the example collar of FIG. 13.

A collar 124 may optionally slidably engage with the outflow tube as suggested in the examples of FIGS. 13-16. In FIG. 13, the example collar 124 has a conical surface 134. The collar may be positioned at any preferred distance from the end 106 of the outflow tube 102. The collar may be held in place with adhesive or a set screw passing through the collar and contacting the outflow tube. The end 106 of the outflow tube preferably enters a chamber in a firearm while the conical surface 134 of the collar 124 seals the opening of the chamber. An end view of the example collar and outflow tube of FIG. 13 is shown in FIG. 14.

Figure 15:
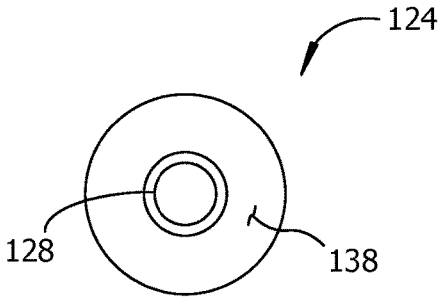
FIG. 15 is a front view of an alternative example of a collar with a spherical surface.
Figure 16:
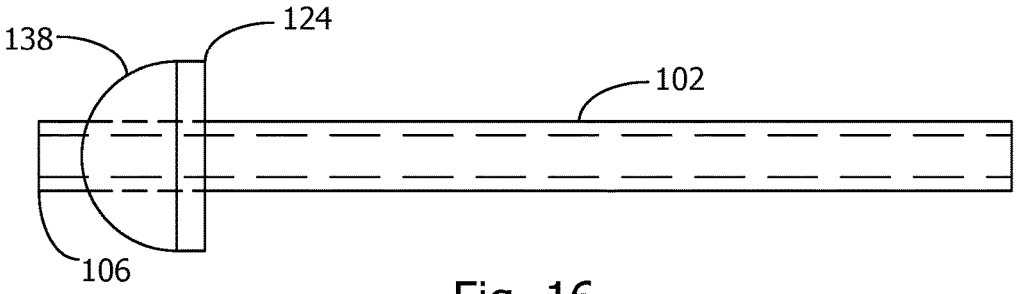
FIG. 16 is a side view of the example collar from FIG. 15 coupled to an outflow tube.

FIG. 15 shows an end view of an alternative collar example having a spherical surface 138. The collar 124 with a spherical surface 138 is shown in a side view in FIG. 16. The end 106 of the outflow tube 102 preferably has an outer diameter sized to enter a chamber in a firearm. The spherical surface 138 of the collar 124 seals against the edge at the breech end of the chamber.

Figure 17:
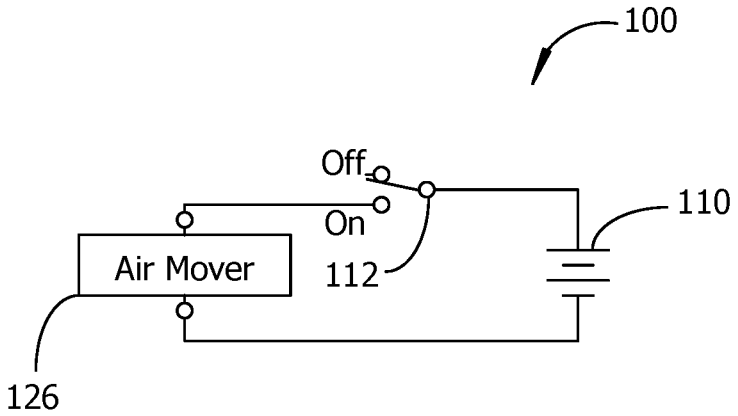
FIG. 17 is a schematic representation of an example electrical circuit for an embodiment.

FIG. 17 shows a simplified schematic diagram of an example of electrical connections between an air mover 126, a switch 112, and at least one electric storage battery 110. More than one storage battery may optionally be connected in series and/or parallel to the battery 110 in FIG. 17 to provide sufficient voltage and current for operating the air mover 126.

Figure 18:
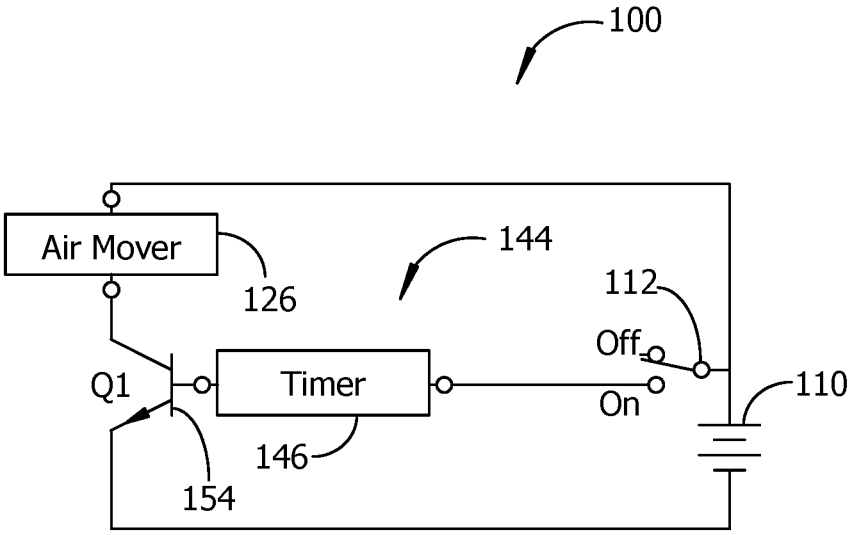
FIG. 18 is a schematic representation of an alternative embodiment including a timer for turning off the air mover after a selected time interval.
Figure 19:
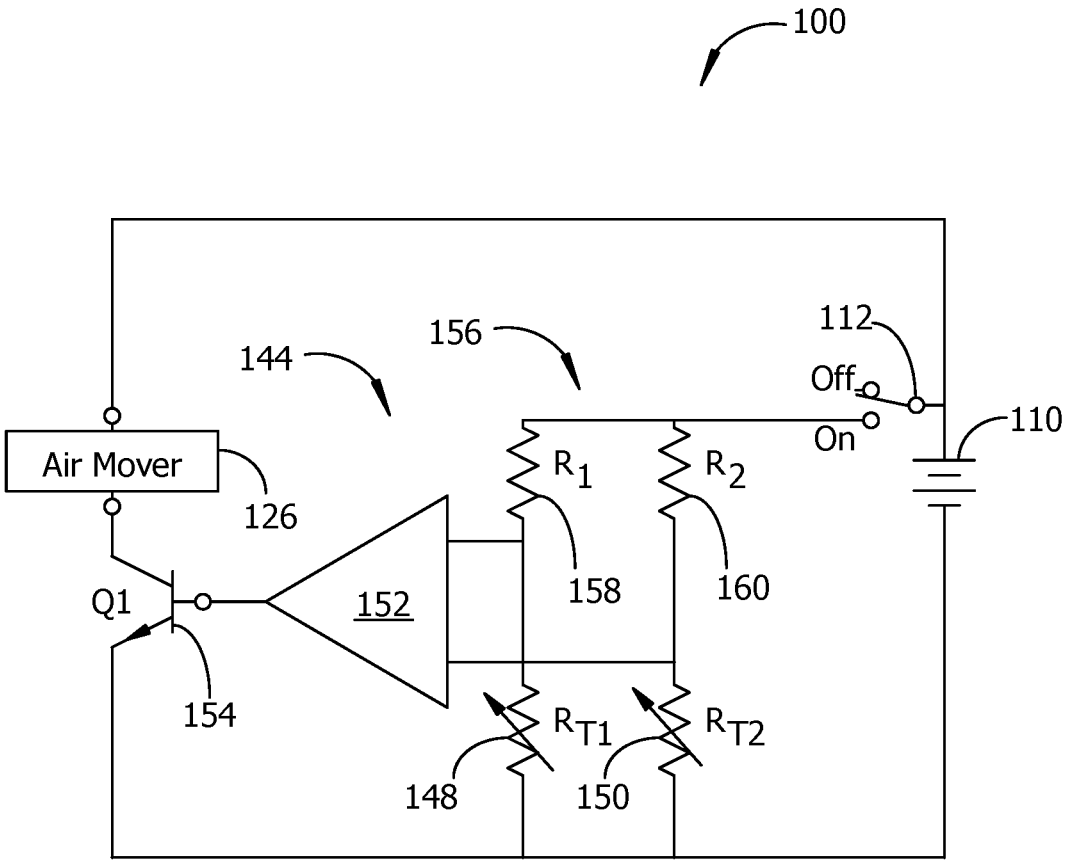
FIG. 19 is a schematic representation of another alternative embodiment including a differential temperature measurement circuit for controlling the operation of the air mover.

FIGS. 18-19 show alternative examples of embodiments having a shut-off-circuit to automatically turn off the air mover. In the example of FIG. 18, a shut-off circuit 144 includes a timer 146 driving a semiconductor switch Q1 154. The air mover 126 is activated by the timer until the expiration of a preferred time interval. At the expiration of the time interval, the air mover is shut off by the timer 146. The air mover may also be shut off by the manually-operated switch 154.

In the example of FIG. 19, the shut-off circuit 144 includes two temperature sensors RT1 148 and RT2 150 connected in a bridge circuit with resistors R1 158 and R2 160 to make a differential temperature measurement. A comparator 152 senses a voltage difference in the bridge circuit caused by temperature differences detected by RT1 148 and RT2 150. When a difference in temperatures detected by RT1 and RT2 is more than a selected magnitude, the comparator 152 activates the air mover 126 by turning on the switch Q1 154. When the temperature difference between the sensors falls below the selected magnitude, the comparator turns the air mover off. Examples of locations for RT1 148 and RT2 150 are shown in FIG. 5. RT1 148 may, for example, be positioned on the outflow tube 102 to detect a temperature of a barrel at a firing chamber in a firearm. RT2 150 may be positioned in the plenum 108 to detect an inlet air temperature. Examples of temperature sensors RT1 and RT2 include, but are not limited to, thermistors and thermocouples.

Unless expressly stated otherwise herein, ordinary terms have their corresponding ordinary meanings within the respective contexts of their presentations, and ordinary terms of art have their corresponding regular meanings.

What is claimed is:

1. An apparatus, comprising:

an enclosure formed with an internal plenum;

an air mover positioned inside said enclosure, said air mover positioned to draw air from outside said enclosure into said plenum;

a hollow outflow tube attached to said enclosure, said outflow tube in fluid communication with said plenum; and an automatic shut-off circuit, comprising:

a first temperature sensor positioned on said outflow tube to detect a temperature of a barrel at a firing chamber in a firearm;

a second temperature sensor positioned in said enclosure to detect a temperature of air drawn into said plenum by said air mover; and a comparator circuit connected to said first and second temperature sensors, said comparator circuit activating said air mover when said temperature of the barrel and said temperature of air drawn into said plenum differ by more than a selected magnitude.

2. The apparatus of claim 1, further comprising:

a switch attached to said enclosure; and at least two electrical contacts for at least one electric storage battery;

wherein said switch and said at least two electrical contacts are electrically connected with said air mover.

3. The apparatus of claim 1, wherein said outflow tube is removably attached to said enclosure.

4. The apparatus of claim 1, wherein said outflow tube includes a first segment formed with a first outer diameter and a second segment formed with a second outer diameter.

5. The apparatus of claim 4, wherein said outflow tube is formed with a circumferential groove between said first segment and said second segment.

6. The apparatus of claim 1, wherein an end of said outflow tube is formed with a conical surface.

7. The apparatus of claim 1, wherein an end of said outflow tube is formed with a spherical surface.

8. The apparatus of claim 1, further comprising a collar slidably engaged with said outflow tube.

9. The apparatus of claim 8, wherein said collar is formed with a conical surface.

10. The apparatus of claim 8, wherein said collar is formed with a spherical surface.

11. The apparatus of claim 1, wherein said enclosure remains outside an action of a firearm when said outflow tube is coupled to said firing chamber.

12. The apparatus of claim 11, wherein said apparatus is an Empty Chamber Indicator.

13. The apparatus of claim 1, wherein said enclosure is formed with an internal space for an electric storage battery.

14. The apparatus of claim 1, wherein said outflow tube is formed from a flexible material.

15. The apparatus of claim 1, wherein said outflow tube is formed from a frangible material.

16. The apparatus of claim 1, wherein said air mover is a fan.

17. The apparatus of claim 1, wherein said shut-off circuit comprises a timer circuit coupling electrical power to said air mover until a selected time interval expires.

* * * * *